United States Patent [19]

Gallagher

[11] Patent Number: 4,471,844

[45] Date of Patent: Sep. 18, 1984

[54] DEVICE FOR CONTAINING AND REMOVING DRILLING SLURRY

[76] Inventor: John L. Gallagher, 611 Harris Rd., Hayward, Calif. 94544

[21] Appl. No.: 427,127

[22] Filed: Sep. 29, 1982

[51] Int. Cl.[3] ..... E21B 12/00

[52] U.S. Cl. ..... 175/209; 173/32

[58] Field of Search ..... 175/209, 210, 211, 217; 166/81; 408/56, 57, 59; 173/32, 33

[56] References Cited

U.S. PATENT DOCUMENTS

| | | | |
|---|---|---|---|
| 2,646,256 | 7/1953 | Löbbert | 175/209 |
| 3,033,298 | 5/1962 | Johnson | 175/209 |
| 3,045,769 | 7/1962 | Feucht | 175/211 |
| 3,498,674 | 3/1970 | Matthews | 175/209 |

*Primary Examiner*—Ernest R. Purser
*Assistant Examiner*—Timothy David Hovis
*Attorney, Agent, or Firm*—Harris Zimmerman; Howard Cohen

[57] ABSTRACT

A device for containing and removing drilling slurry includes a pair of concentric, annular, parallel side walls joined at like edges to an annular end wall to form an annular cavity therein. The opposed edges of the side walls are provided with annular sealing gaskets, the gasket on the inner wall being provided with radially extending intake slots. A vacuum fitting extends through the outer side wall to partially evacuate the cavity and to cause the device to adhere to a floor or wall surface. The end wall includes a central opening therethrough to receive a drilling bit or the like, the opening being slightly eccentric with respect to the axis and defining a shallow recess which retains liquid slurry. A pair of drain holes extend through the inner side wall at the shallow recess to remove accumulated slurry.

6 Claims, 5 Drawing Figures

DEVICE FOR CONTAINING AND REMOVING DRILLING SLURRY

BACKGROUND OF THE INVENTION

In the field of building construction, it is quite commonplace for concrete or concrete-like materials to be employed in the fabrication of floor slabs, wall slabs, reinforcing beams, and the like. Techniques in formulating, pumping, and casting concrete have advanced to a point that concrete is unrivaled as a building material for many construction projects. Such projects are not limited to commercial or industrial uses, and also include residential uses, transportation projects, and the like.

Although concrete in semi-fluid form is extremely easy to cast and form in a desired shape, cured concrete is extremely hard and extremely difficult to drill, cut, or otherwise reshape in any form. Oftentimes floor or wall slabs are cast with openings pre-formed therein to accommodate the mechanical systems of a building under construction, such as electrical conduit openings, HVAC duct openings, plumbing runs, or the like. However, practical experience has shown that it is almost always necessary to create further openings in the concrete floor or wall slabs to accommodate changes in the building design, unique requirements of the building tenants, or the like. As a result, a large and flourishing industry has been created specifically to cut or drill cast and cured concrete.

When it is required to bore a hole in cured concrete, it is necessary to use a high strength boring bit, such as a diamond tipped bit, and to use a liquid lubricant to increase the boring speed through the concrete and to decrease wear on the boring bit. The drill lubricants also carry away not only the substantial heat which is generated during the boring process, but also the debris which comprises the material removed from the slab to form the hole. The lubricant liquids used in boring holes in concrete include water and also aqueous solutions of lubricant compounds.

As a hole is bored through cured concrete, the lubricant combines with the drilling debris to form a muddy slurry. Due to the fact that a large amount of drilling lubricant is often required, the volume of drilling slurry generated by the drilling operation is also quite large. This muddy slurry can create a substantial clean-up problem, especially when the hole being drilled is within an occupied building. Generally speaking, there is no device known in the prior art for easily containing and removing the drilling slurry before it creates a messy worksite which must be cleaned after the drilling operation is finished.

The following United States patents comprise the closest known prior art:

| | |
|---|---|
| 2,829,867 | 3,033,298 |
| 2,870,993 | 3,351,143 |
| 2,946,246 | 4,205,728 |

SUMMARY OF THE PRESENT INVENTION

The present invention generally comprises a device for containing and removing drilling slurry. The invention includes a pair of concentric, annular, parallel side walls joined at like edges to an annular end wall to define an annular cavity therebetween. The opposed edges of the side walls are provided with annular sealing gaskets to engage a floor or wall surface in a low pressure seal, the gasket on the inner wall being provided with radially extending intake slots. A vacuum fitting extends through the outer side wall to a negative pressure source to partially evacuate the cavity and to cause the device to adhere to a floor or wall surface. The end wall includes a central opening therethrough to receive a boring bit or the like, the inner sidewall containing the slurry generated by the boring process carried on within the confines thereof. The opening is disposed slightly eccentrically with respect to the axis and defining a shallow recess which retains liquid slurry when the device is adhered to an upwardly extending surface. A pair of drain holes extend through the inner side wall at the shallow recess to remove accumulated slurry.

DESCRIPTION OF THE PREFERRED EMBODIMENT

Figure 1:
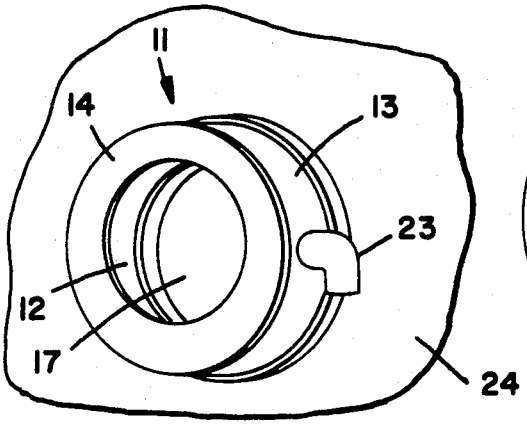
FIG. 1 is a perspective view of the device of the present invention for containing and removing drilling slurry.

The present invention generally comprises a device for containing and removing the slurry which is generated by the boring of a hole through a hard masonry surface, such as concrete, terrazzo, and the like. A salient feature of the present invention is that it completely circumscribes the boring site, and it contains the slurry within a very small area. Thus the present invention eliminates the wide-spread clean-up problem usually associated with boring holes in concrete. Furthermore, the present invention effectively removes the slurry from the worksite so that little clean-up remains to be done after the hole is completed. Moreover, the device may be used in conjunction with boring a hole in a masonry surface extending at virtually any angle to horizontal.

With reference to the accompanying figures, the device 11 of the present invention includes a pair of inner and outer side walls 12 and 13, respectively. The side walls 12 and 13 are generally cylindrical in configuration and concentric in disposition, the walls being generally parallel and spaced apart in the radial direction. The device 11 also includes an annular end wall 14 which is joined to adjacent end surfaces of the side walls 12 and 13. It may be appreciated that the end wall 14 and the side walls 12 and 13 together define an annular chamber 16 having a distal open annulus. Furthermore, the end wall 14 includes an opening 17 extending therethrough, the opening 17 having a diameter substantially similar to the inner diameter of the inner side wall 12. The opening 17 is provided so that the boring bit of a drilling assembly may be extended therethrough, as will be explained in the following description.

Joined to the distal end portions of the side walls 12 and 13 is a pair of gaskets 18 and 19, respectively. Each of the annular gaskets 18 and 19 includes a rectangular channel formed therein to receive the end portion of the respective side wall. In the preferred embodiment, each gasket further includes a plurality of radially spaced, concentric, annular ribs 21 extending distally therefrom. The ribs 21 are provided to form a low pressure seal with the planar surface in which the hole is to be bored. The gasket 18 further includes a plurality of intake slots 22 extending radially therein and spaced circumferentially thereabout. Each of the slots 22 is disposed in the distal portion of the gasket 18, each slot 22 traversing the ribbed portion 21 of the gasket 18. The slots 22 are provided to draw into the chamber 16 the slurry generated by the boring operation which takes place within the opening 17 of the device 11.

The device 11 further includes a vacuum fitting 23 extending through the outer side wall 13 and disposed in open flow communication with the annular chamber 16. In the preferred embodiment, the vacuum connector 23 is dimensioned to receive the flexible intake hose of any common vacuum cleaning device, such as a "shop vacuum" which is designed to take in wet or dry debris and waste in a workshop setting. It may be appreciated that the partial vacuum applied to the coupling 23 creates a partial vacuum within the annular chamber 16. With the ribbed surfaces 21 of the gaskets 18 and 19 disposed in substantially flush contact with a planar surface 24 (FIG. 1), the ambient air pressure exerted on the outer surface of the end wall 14 is substantially greater than the reduced pressure within the annular chamber 16. As a result, the device 11 is urged by great force to impinge upon the surface 24 and to maintain engagement therewith. This "suction" effect is sufficient to retain the device 11 on a vertical or horizontal planar surface.

Figure 2:
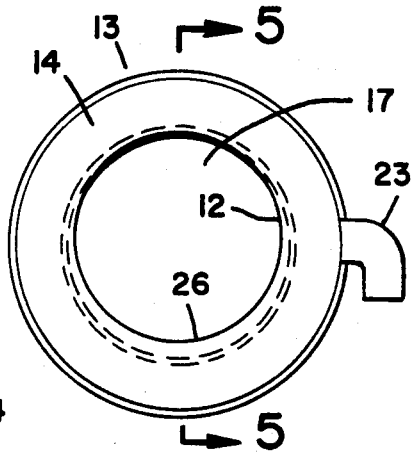
FIG. 2 is a top plan view of the device for containing and removing drilling slurry.
Figure 3:
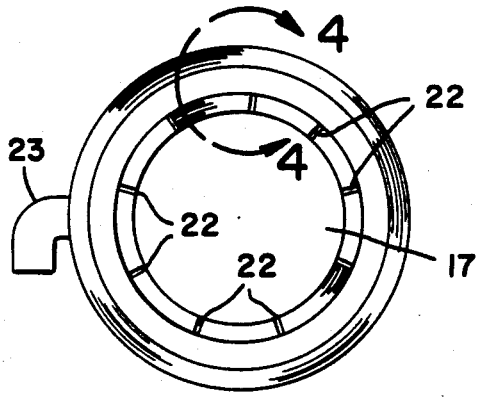
FIG. 3 is a bottom plan view of the present invention as shown in FIG. 2.
Figure 5:
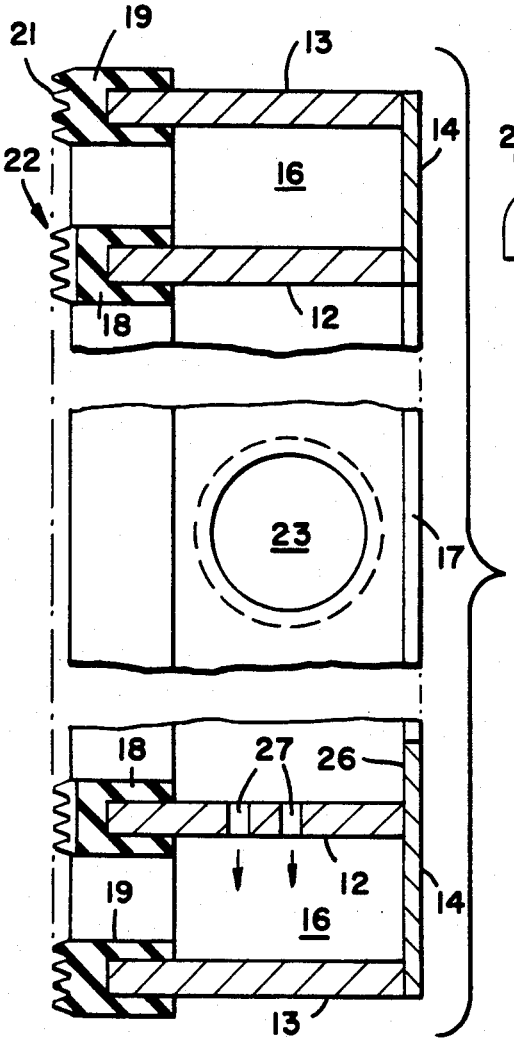
FIG. 5 is a cross-sectional side view of the present invention, taken along line 5—5 of FIG. 2.
Figure 4:
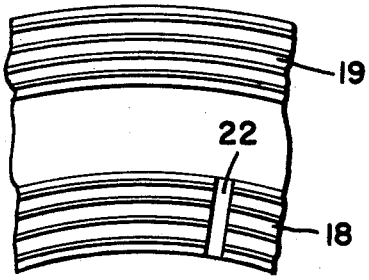
FIG. 4 is an enlarged detailed view of a portion of the present invention.

Indeed, the present invention is particularly adapted to be used in drilling or boring a hole in a substantially vertical wall surface. It should be noted that the opening 17 in the end wall 14 is disposed slightly eccentrically with respect to the axes of the side walls 12 and 13. Although a portion of the periphery of the opening 17 is disposed substantially flush with the inner diameter of the inner wall 12, a portion 26 of the end wall 14 is out of registration with the inner surface of the inner side wall, and extends radially inwardly therefrom. The portion 26 together with the curved portion of the side wall 12 directly adjacent thereto forms a shallow, concave recess within the large central opening of the device 11. With the device 11 disposed as depicted in FIG. 2 and secured to a vertical wall surface, the shallow recess 26 comprises a shallow reservoir in which the drilling slurry will accumulate gravitally as it is generated during the drilling or boring process.

A salient feature of the present invention is the provision of a plurality of drain holes 27 extending through the inner side wall 12 from the annular chamber 16 to the central opening of the device. The holes 27 are disposed with the recess 26, and are positioned to drain the accumulated slurry therefrom. It may be appreciated that the reduced pressure within the chamber 16 will cause a constant inflow of ambient air into the chamber 16. This inflow also quickly removes the accumulated slurry from the recess 26.

It may be appreciated that the boring operation which takes place within the central opening of the device 11 easily may cause the slurry to spray radially outwardly from the boring face. However, due to the fact that the device 11 circumscribes the boring bit and is intimately engaged with the surface in which the boring operation is occurring, there is little opportunity for the slurry to escape from the confines of the present invention. Furthermore, the slots 22 in the gasket 18 also provide for the intake of ambient air into the partially evacuated chamber 16. The slots 22 further serve to take in the slurry as it is sprayed or splashed onto the surface 24 or the inner surface of the side wall 12. It should be noted that the volume of air drawn into the device through the holes 27 and the slots 22 is substantially less than the volume of air which is taken in by the vacuum system connected to the member 23. Therefore, the suction engagement of the device 11 on the surface 24 is not reduced by this minimal air inflow.

I claim:

1. A device for retaining and removing slurry from drilling site, including; a pair of concentric, annular sidewalls, an annular end wall joined to like edges of said sidewalls, said sidewalls and end wall together defining single annular cavity means for both securing said device to said masonry surface by suction action and also for removing said slurry from the drilling site, sealing means joined to the opposed edges of said side walls to form a low pressure seal with a masonry surface, the inner one of said sidewalls circumscribing said work site, said inner sidewall defining an acess opening to said work site and containing slurry generated thereat, negative pressure means connected to said single annular cavity means to cause said device to adhere to said masonry surface by suction action and to remove slurry from said cavity, and intake means extending from said access opening to said annular cavity means to draw slurry from said drilling site into said single annular cavity means.

2. The device of claim 1, wherein said sealing means includes gasket means joined to the distal edge portions of said sidewalls and disposed to engage a masonry surface.

3. The device of claim 2, wherein said gasket means includes a pair of annular gaskets, each joined to the distal edge portion of one of said sidewalls.

4. The device of claim 3, wherein said intake means includes a plurality of intake slots extending through said annular gasket joined to said inner side wall, said intake slots extending from said access opening to said annular cavity.

5. A device for retaining and removing slurry from a drilling site, including; a pair of concentric, annular sidewalls, an annular end wall joined to like edges of said sidewalls, said sidewalls and end wall together defining an annular cavity therein, sealing means joined to the opposed edges of said side walls to form a low pressure seal with a masonry surface, the inner one of said sidewalls circumscribing said work site, said inner sidewall defining an access opening to said work site and containing slurry generated thereat, negative pressure means connected to said annular cavity to cause said device to adhere to said masonry surface by suction action and to remove slurry from said cavity, intake means extending from said access opening to said annular cavity to draw slurry from said work site into said annular cavity, a central opening formed in said end wall and communicating with said access opening, said central opening being disposed non-concentrically with respect to said inner sidewall, a shallow reservoir for slurry formed by said inner sidewall, said masonry surface, and a portion of said end wall adjacent to said central opening and extending radially inwardly from said inner sidewall.

6. The device of claim 5, wherein said intake means includes at least one drain hole extending through said inner side wall from said shallow concave reservoir to said annular cavity.

* * * * *